US005475413A

United States Patent [19]

Hashimoto et al.

[11] Patent Number: 5,475,413

[45] Date of Patent: Dec. 12, 1995

[54] PORTABLE RECORDING APPARATUS HAVING RELATIVELY MOVABLE HOUSING SECTIONS

[75] Inventors: Kenichiro Hashimoto, Yokohama; Junichi Asano, Kawasaki, both of Japan

[73] Assignee: Canon Kabushiki Kaisha, Tokyo, Japan

[21] Appl. No.: 968,327

[22] Filed: Oct. 29, 1992

[30] Foreign Application Priority Data

Oct. 31, 1991 [JP] Japan ..... 3-313990
Nov. 1, 1991 [JP] Japan ..... 3-287841

[51] Int. Cl.[6] ..... B41J 3/36

[52] U.S. Cl. ..... 347/108; 400/680

[58] Field of Search ..... 346/140 R, 134; 400/171, 680, 88; 347/108, 104, 138, 152, 170, 222, 245, 263, 109

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,725,157 | 2/1988 | Nakai et al. | 400/680 |
| 4,740,796 | 4/1988 | Endo et al. | 347/56 |
| 4,946,300 | 8/1990 | Makita | 400/682 |
| 5,099,289 | 3/1992 | Kurotori et al. | 355/290 |
| 5,207,521 | 5/1993 | Ricca et al. | 400/647.1 |
| 5,258,773 | 11/1993 | Arakawa et al. | 346/1.1 |

FOREIGN PATENT DOCUMENTS

| | | | |
|---|---|---|---|
| 0271090 | 6/1988 | European Pat. Off. | 347/108 |
| 0497571 | 8/1992 | European Pat. Off. . | |
| 0501789 | 9/1992 | European Pat. Off. . | |
| 3408594 | 9/1985 | Germany . | |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 63-192113 | 8/1988 | Japan . | |
| 63-252766 | 10/1988 | Japan . | |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

A recording apparatus includes a first housing having a control unit for controlling a recording mechanism for recording onto a recording medium and a feed mechanism for feeding the recording medium, a second housing connected movably to the first housing, and housing an attaching portion for attaching the recording mechanism thereto and the feed mechanism, and an operation portion. Access to the operation portion is unnecessary when the recording apparatus is not in use and, therefore, it is covered and protected with the second housing, but is opened by the rotation of the second housing when recording. The recording apparatus is placed in a thin form convenient for transportation or storage when not in use or in a form suitable for the conveyance of the recording medium when in use. When in use, the exterior of the first housing can form a part of a conveyance route of the recording medium.

19 Claims, 13 Drawing Sheets

PORTABLE RECORDING APPARATUS HAVING RELATIVELY MOVABLE HOUSING SECTIONS

BACKGROUND OF THE INVENTION

1. Field of the Invention

The present invention relates to a recording apparatus for recording onto a recording medium, and more particularly to a recording apparatus capable of taking an appropriate form depending on the service or non-service time.

2. Related Background Art

In recent years, host computers have been made in compact size as typically found in personal computers, and more recently, notebook type computers of A-4 size have spread widely. Correspondingly, recording apparatuses which are output devices for such computers have been developed in smaller sizes, whereby the notebook and slender parallelopiped types have appeared so as to be not only portable but also storable in the drawer of a desk.

In particular, recording means (recording head) of the ink jet type in which the ink is discharged by the use of heat energy can be readily fabricated with an arrangement having a high density of liquid channels (arrangement of discharge ports) by forming electricity-heat converters, electrodes, liquid channel walls and a ceiling plate as the film on a substrate by a semiconductor fabrication process such as etching, vapor deposition or sputtering, thereby allowing for further compactization.

However, with the progress of compactization for the transportation and storage, the difference (gap) between the optimal form for the service and that for the non-service has become evident, bringing about some inconveniences.

That is, it is preferable that the apparatus is as thin and compact in geometry as possible for the transportation or storage, whereas it is desirable on account of the utilization that the apparatus is retained in a shape suitable for the insertion, conveyance and exhaust of the sheet which is a recording medium, when used for the recording. Such a shape is generally quite different from a flat shape suitable for the transportation and storage. If the conveyance passage of a sheet is sought to approximate a preferably horizontal path, recording of the sheet is performed in a vertical direction, so that a recording head must be configured to be oriented in a longitudinal direction, when the recording apparatus is in the service state, thereby having a considerable height. And this may lead to an unstable attitude at the service time as the compactization and lighter weight of the whole apparatus have progressed.

It is required that unnecessary parts at the non-service time, such as an interface (I/F) connector, a power supply connector and a dip switch, are protected from being stained or damaged by the transportation and storage.

SUMMARY OF THE INVENTION

An object of the present invention is to resolve the aforementioned problems, and to provide a recording apparatus that's highly reliable and readily usable by taking an optimal form of the apparatus depending on whether it is used or not.

Another object of the present invention is to provide a recording apparatus in which an operation unit unnecessary to operate at the non-service time for the transportation and storage, comprising for example connectors, is protected from being stained or damaged.

Also, another object of the present invention is to provide a compact and light recording apparatus which is retained in a compact shape when not used, while in a functional and stable state when used.

Further, another object of the present invention is to provide a recording apparatus comprising a first housing having a control unit for controlling a recording mechanism for recording onto a recording medium and a feed mechanism for feeding said recording medium, a second housing which is movably connected to said first housing in recording, and having an attaching portion for attaching said recording mechanism thereto and said feed mechanism, and an operation unit provided on said first housing, which is unnecessary to operate and is covered with said second housing at the non-service time of the recording apparatus, but is opened by the rotation of said second housing in recording.

DETAILED DESCRIPTION OF THE PREFERRED EMBODIMENTS

The preferred embodiments of the present invention will be described below with reference to the drawings, wherein one of the objects is to provide a recording apparatus readily usable and highly reliable by taking an optimal apparatus form depending on whether it is used or not.

First, a recording apparatus of the type in which the supply of electric energy to the recording apparatus is performed using an electric cord will be described.

Figure 1:
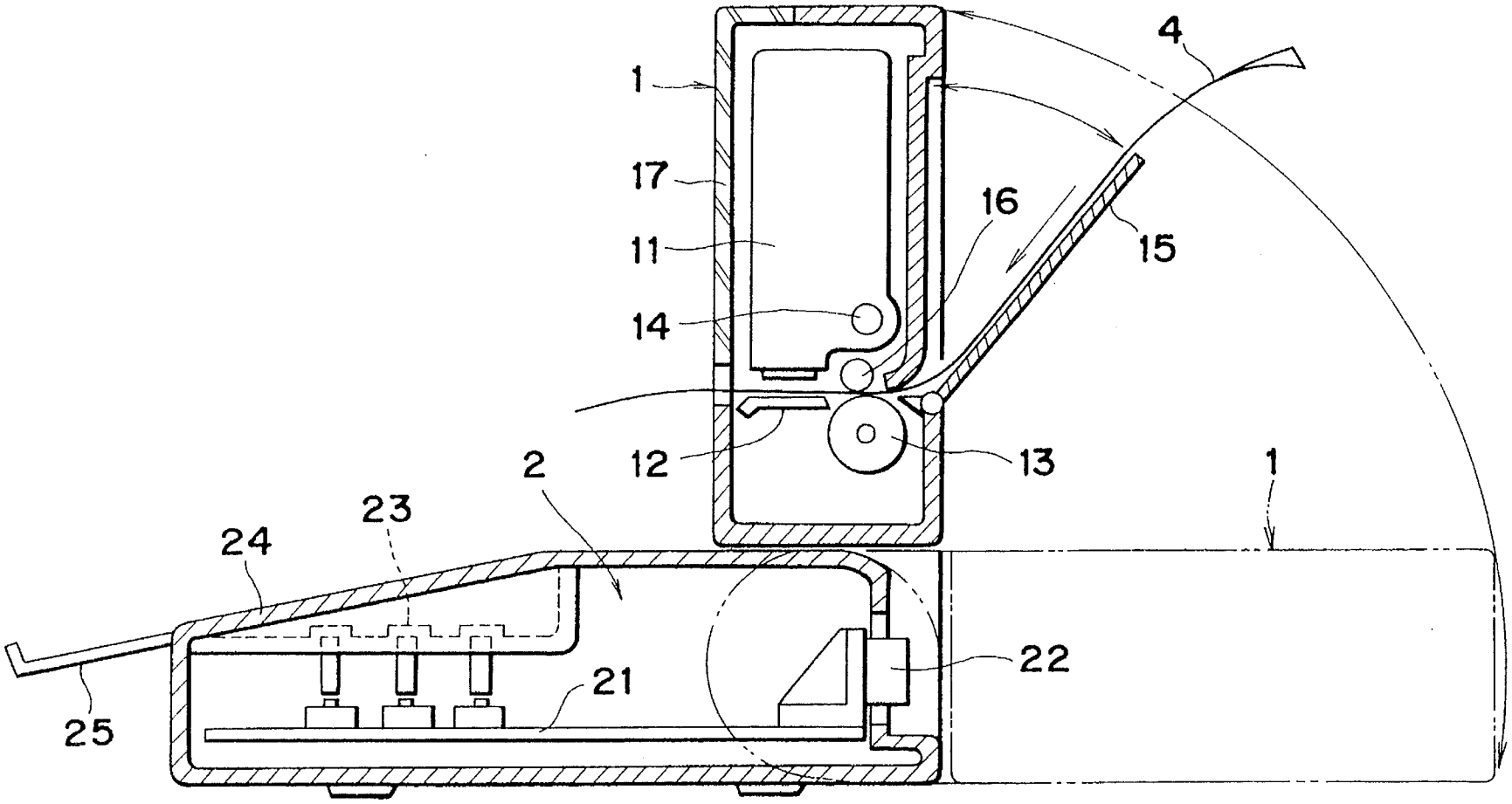
FIG. 1 is a longitudinal cross-sectional view schematically showing the constitution of a recording apparatus according to a first embodiment of the present invention.

FIG. 1 is a schematic longitudinal cross-sectional view of a recording apparatus according to the first embodiment of the present invention. Note that the solid lines in FIG. 1 indicate a service state of the recording apparatus and the two-dot chain lines indicate a non-service state. In FIG. 1, 1 is a recording mechanism unit, which is composed of a recording head (recording means) 11, a platen 12, a paper feed roller 13, a guide shaft 14 for guiding the reciprocatory movement (main scan) of the recording head 11 along a recording medium 4, a driving motor (not shown) for driving the recording head 11 (or a carriage) in reciprocating motion, mechanical components required for the recording such as a belt mechanism (not shown) to transmit the power of the driving motor, a sensor and a motor. Reference numeral 2 is a control unit which is composed of a control substrate 21, an interface connector 22, a panel switch portion 23, and control and interface related components.

FIG. 1 shows an ink jet recording apparatus as the recording apparatus, in which the recording head 11 is an ink jet recording head which discharges the ink by the use of the heat energy, and comprises electricity-heat converters for generating the heat energy. Also, the recording head 11 performs the recording by discharging the ink through discharge ports by the use of the pressure change arising due to growth and shrinkage of bubbles produced by film boiling caused by the heat energy to be applied by the electricity-heat converters.

Figure 2:
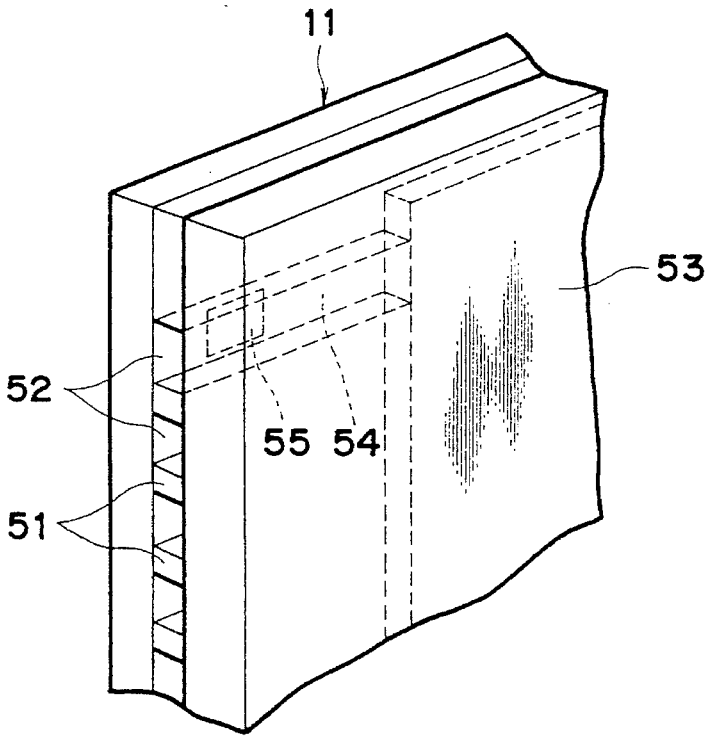
FIG. 2 is a partial perspective view schematically showing the structure of an ink discharge portion of a recording head as shown in FIG. 1.

FIG. 2 is a partial perspective view schematically showing the construction of an ink discharge portion in the recording means (recording head) 11. In FIG. 2, there are arranged a plurality of discharge ports 52 at a predetermined pitch on a discharge port formation face 51 spaced a predetermined clearance (e.g., about 0.5 to 2.0 millimeter) away from a recording medium 4, with electricity-heat converters 55 (e.g., heat generating resistors) for generating the ink discharge energy each being disposed along a wall face of each liquid channel 54 communicating a common liquid chamber 53 to each discharge port 52. In this embodiment, the recording head 11 is mounted in a positional relation in which the discharge ports 52 are arranged in a direction transverse to a main scan direction (a moving direction of the recording head 11). Thus, the recording head 11 is configured in such a way that on the basis of an image signal (record data) or a discharge signal, corresponding electricity-heat converters 55 are driven (energized) to film boil the ink within the liquid channels 54, so that the ink is discharged through the discharge ports 52 by the pressure produced at that time.

Figure 3:
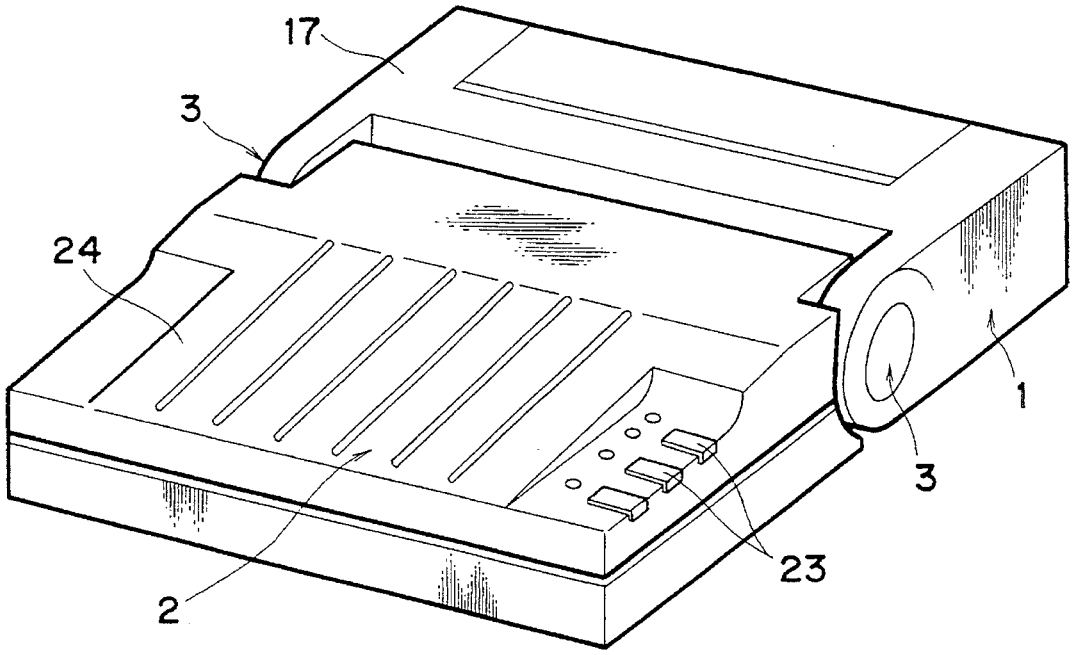
FIG. 3 is a schematic perspective view showing a state of the recording apparatus as shown in FIG. 1 at the non-service time.
Figure 4:
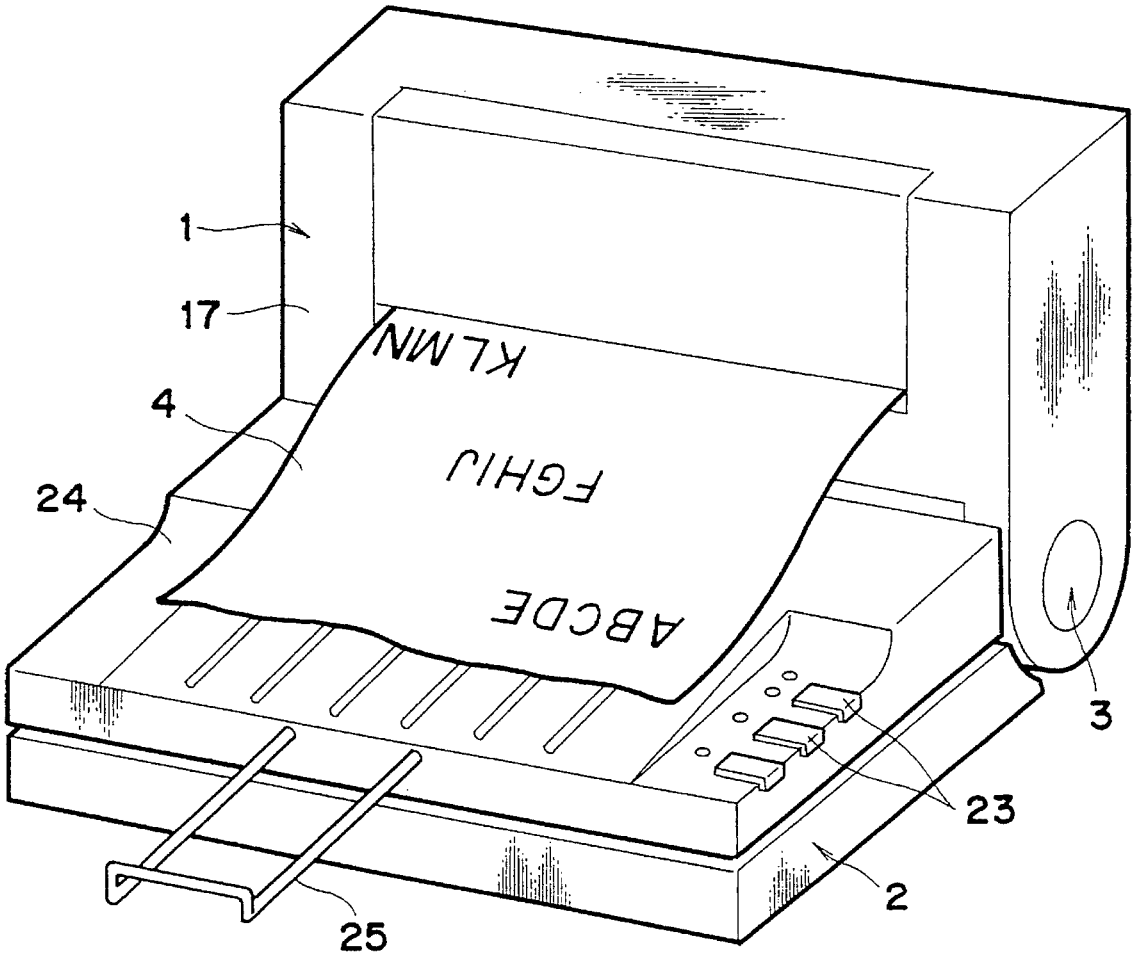
FIG. 4 is a schematic front perspective view showing a state of the recording apparatus as shown in FIG. 1 at the service time.

FIG. 3 is an external perspective view of the recording apparatus (first embodiment) as shown in FIG. 1, in which the recording mechanism unit 1 and the control unit 2 are rotatably joined at a hinge portion 3 (two positions on the left and right sides). FIG. 3 shows the recording apparatus of thin notebook type in the non-service state, which is very convenient for the transportation and storage. FIG. 4 is an external perspective view showing the recording apparatus (first embodiment) as shown in FIG. 1 in the service state. In FIGS. 3 and 4, the recording mechanism unit 1 can be turned about 90 degrees around the hinge portion 3 from the non-service state of FIG. 3 to the service state of FIG. 4, and in the service state, a recording medium 4 is inserted from behind the apparatus, and exhausted to the front side of the apparatus.

Figure 5:
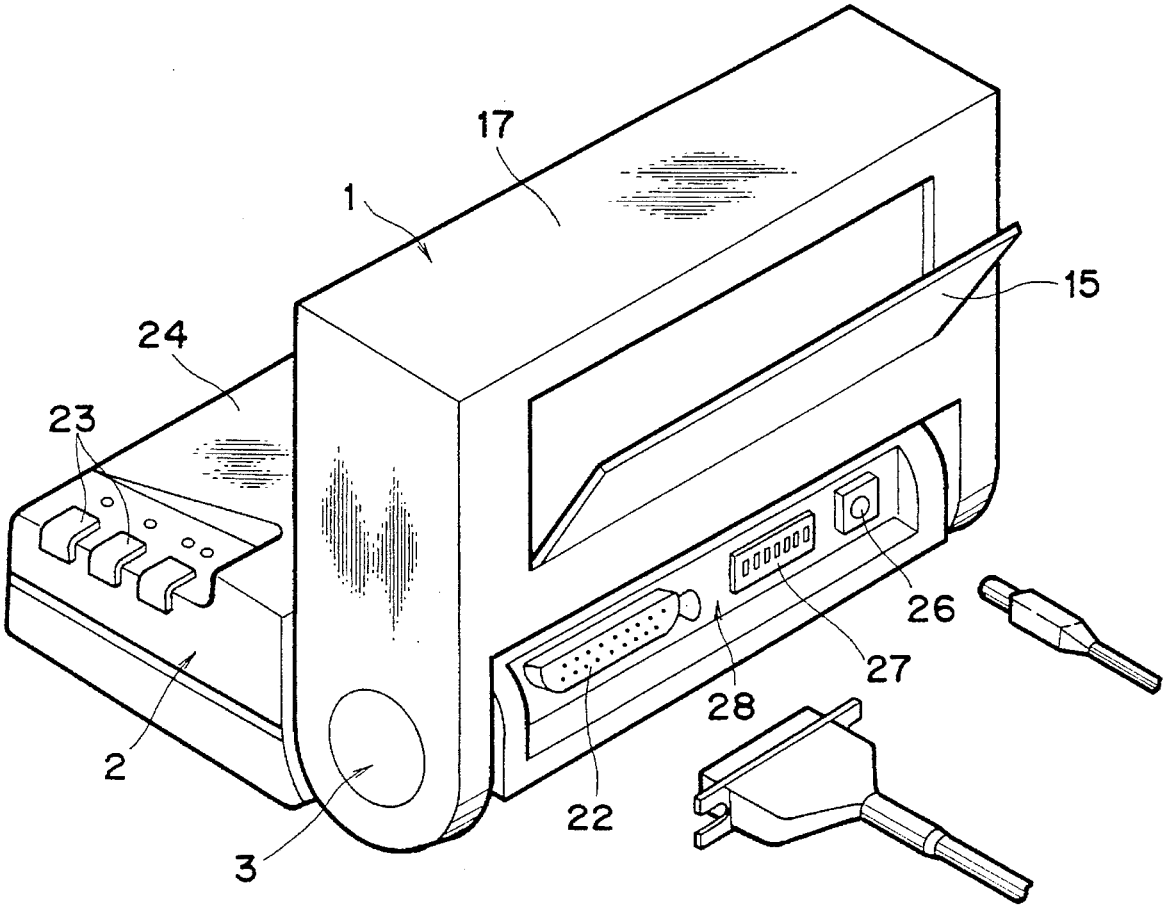
FIG. 5 is a schematic rear perspective view showing a state of the recording apparatus as shown in FIG. 1 at the service time.

FIG. 5 is a rear perspective view of the recording apparatus as shown in FIG. 4 in the service state as viewed from the rear side. In the service state, an interface connector 22, a power source connector 26, and a dip switch 27 are provided on a back face of the control unit 2 exposed by the pivotal movement, as shown in FIG. 5, whereby an input/output portion (I/O) protected in the non-service state (FIG. 3) is placed in an enable state when used (FIGS. 4 and 5). That is, the apparatus is a thin type as indicated by the two-dot chain line in FIG. 1 when not operated (or used), but the apparatus is placed in a recordable state by pivoting the recording mechanism unit 1 and the control unit 2 about 90 degrees at the time of recording operation (service). For the recording operation, the interface connector 22 and the power supply switch 26, which are exposed as shown in FIG. 5, are connected, and a power supply SW (not shown) is turned on to start the recording operation.

In the first embodiment as above described, a paper supply tray 15 which can be opened and closed is provided on a back face in the service state (a bottom face in the non-service state) in which the recording mechanism unit 1 is positioned uprightly whereby in the recording operation, the paper supply tray 15 is opened to insert a recording medium 4 such as a paper or plastic thin plate thereinto. And the apparatus is turned on-line to start the recording in a state in which the recording medium 4 is supplied between a paper feed roller 13 and a pinch roller 16. A recording signal is sent from the control unit 2 through the hinge portion 3 to a motor or the recording head 11 in the recording mechanism unit 1, via a signal line (not shown) connected to the recording mechanism unit 1. 10 The recording medium 4 is conveyed to a platen 12 and set at a predetermined leading position, and then the recording head is driven in reciprocating motion (scanning) along a guide shaft 14 by a driving source such as a pulse motor (not shown) to perform the recording. If one line of recording is terminated, the recording medium 4 is fed by a predetermined amount, then stopped at a next line position, and the next line is recorded by moving the recording head 11 again. By repeating such scanning and feed, one page of recording is performed. The recording mechanism unit 1 for performing such recording is accommodated in a case 17 provided separately from the control unit 2.

While in the first embodiment an ink jet recording head integral with an ink tank is used as the recording head 11, it should be noted that an ink jet recording head separate from the ink tank, and further, a recording head relying on the thermal transfer method, thermal method, wire dot method, laser beam method, or other methods may be used.

The recording medium 4, which has been recorded on, is delivered from the recording mechanism unit 1, and exhausted on to a case 24 of the control unit 2. The case 24 of the control unit is provided with an extension tray 25 formed of a wire so that it can be extended or retracted, whereby if the extension tray 25 is drawn out at the recording, the recorded recording medium 4 can be laid down on the extension tray 25 without falling away from the recording apparatus. A panel switch portion 23, provided on the upper face of the case 24 in the control unit 2, is disposed at a position out of the conveying path of the recording medium 4, that is, at a right or left end portion on the upper face of the case 24, so that it can be operated even when the recording medium 4 is laid down.

Figure 6:
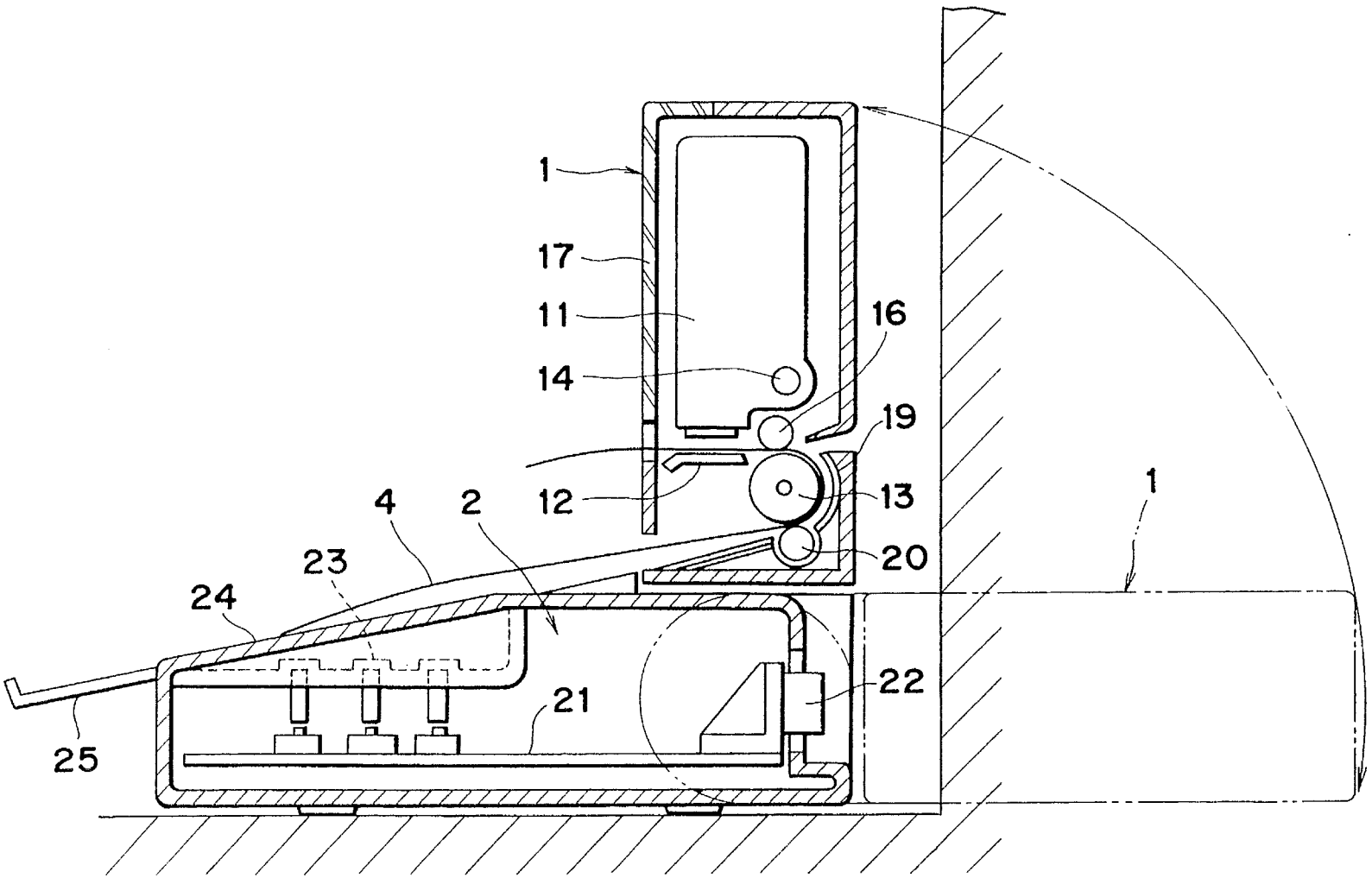
FIG. 6 is a longitudinal cross-sectional view schematically showing a recording apparatus according to a second embodiment of the present invention.

FIG. 6 shows a recording apparatus according to a second embodiment, in which a U-shaped conveyance passage is provided along the peripheral surface of paper feed roller 13 so that the recording medium 4 is inserted from the front face of the recording mechanism unit 1 and exhausted out of the same face.

As shown in FIG. 6, the recording medium 4 is inserted into the recording mechanism unit 1 so as to follow the upper face of a case 4 for the control unit 2, and fed like a U-turn to the position of a pinch roller 16 by a pinch roller 20 and a paper guide 19. Thereafter, the recording is performed by the recording head 11, and the paper is exhausted on to the upper face of the case 4 for the control unit 2.

In the recording apparatus as shown in FIG. 6, a paper conveying mechanism is unnecessary on the rear face side of the recording apparatus. And the rear face side of the recording apparatus can be positioned against a wall or the like by using connectors for attaching the cord transversely, thereby minimizing a space for installing the recording apparatus. Other portions have the same constitution as in the first embodiment, wherein corresponding parts are indicated by the same numerals. It will be appreciated that the recording head 11 for use may rely on any one of a variety of methods exemplified in the first embodiment, in addition to the ink jet recording head.

According to the first and second embodiments as shown in FIGS. 1 to 6, the recording mechanism unit 1 and the control unit 2 are respectively contained in separate cases 17, 24, which are rotatably joined together by the hinge portion 3 (rotatable about 90 degrees), so that the apparatus is placed in a form suitable for the conveyance of the recording medium 4 when used, or in a thin form convenient for the transportation and storage when not used, whereby a recording apparatus excellent in handling and compact in size can be obtained. Also, an interface connector 22, a power supply connector 26 and a dip switch 27 for the setting of the apparatus functions, which are operation parts unnecessary during the non-service, provided on the control unit 2 or the case 24, are arranged on a plane covered by the case 17 of the recording mechanism unit 1 during the non-service, whereby a recording apparatus can be obtained in which such operation parts can be effectively protected from being stained or damaged at the transportation and storage.

Figure 7:
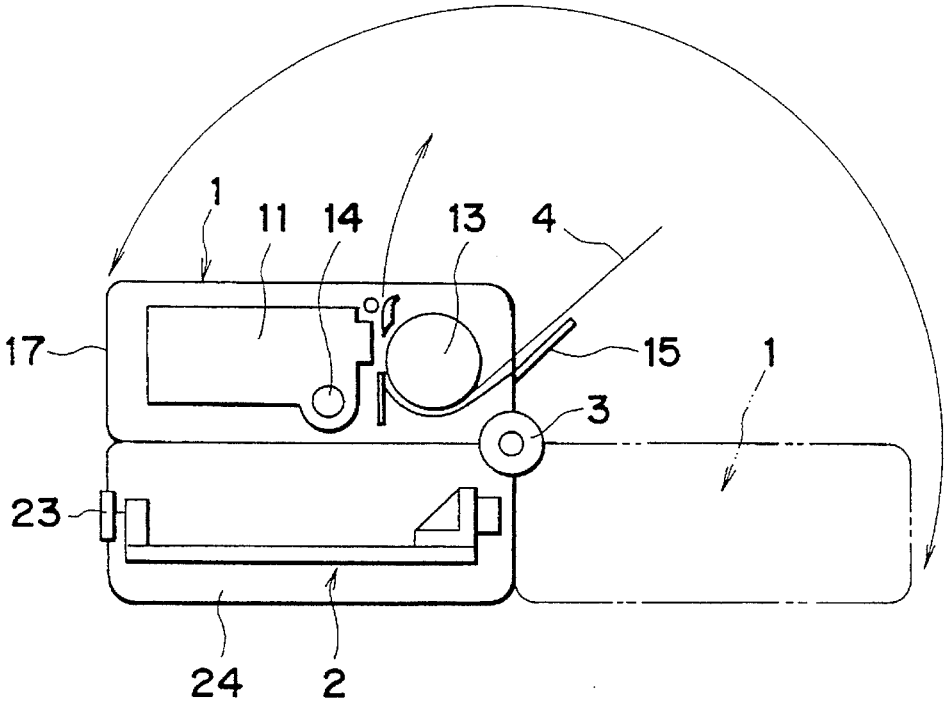
FIG. 7 is a schematic side view of a recording apparatus according to a third embodiment of the present invention.

FIG. 7 is a schematic side view showing a recording apparatus according to the third embodiment of the present invention. In this embodiment, the recording apparatus is configured to take a service state as indicated by the solid line and a non-service state as indicated by the two-dot chain line by rotating the recording mechanism unit 1 and the control unit 2 around the hinge portion 3 about 180 degrees. In FIG. 7, corresponding parts to the first and second embodiments as shown in FIGS. 1 to 6 are indicated by the same numerals, and the detailed explanation will be omitted. With this embodiment, the recording apparatus can also take a thin form convenient for the transportation and storage at the non-service time, and a form convenient for the conveyance of the recording medium 4 at the service time, whereby this embodiment can realize to the same effect as in the first and second embodiments. With the third embodiment of FIG. 7, the recording apparatus can be formed without excess bulge by making its cross section a rectangle close to a square in the service state. That is, in both the service and non-service states, the apparatus is favorable for the transportation and storage, and permits the user to select either form at the non-service time.

Figure 8:
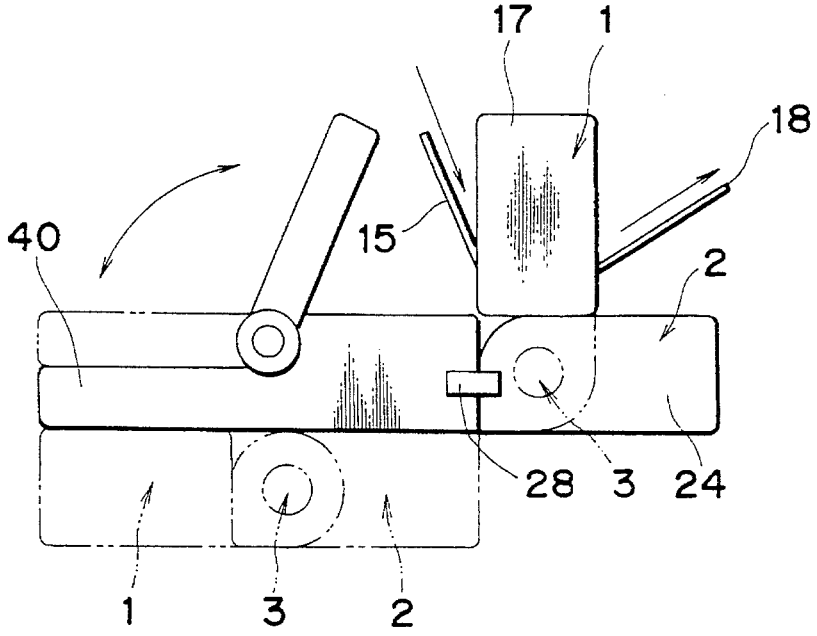
FIG. 8 is a schematic side view of a recording apparatus according to a fourth embodiment of the present invention.

FIG. 8 is a schematic side view showing a recording apparatus according to the fourth embodiment of the present invention. In this embodiment, the recording mechanism unit 1 is joined with the control unit 2 via the hinge portion 3 to be rotatable about 90 degrees therearound, like in the first and second embodiments. However, on the front face of the recording mechanism unit 1, there is provided a paper exhaust tray 18 which can be opened or closed, and further, on the rear face of the control unit 2, there is provided a connector portion 28 such as an interface connector 22, a power supply connector 26 and a dip switch 27, to which a note-type personal computer 40 as the host computer is integrally connected. Other portions are substantially the same as in the first embodiment as shown in FIGS. 1 to 5, wherein corresponding parts are indicated by the same numerals, and the detailed explanation thereof is omitted. The solid lines as in FIG. 8 indicate the recording apparatus at the service time which is connected to the personal computer 40, while the two-dot chain lines indicate the thin recording apparatus at the non-service time which is stored under the personal computer 40.

The fourth embodiment of FIG. 8 can realize the same effect as in the first embodiment, and further, as the connector portion 28 of the control unit 2 is directly joined with the personal computer (host) 40, the cord for electrical connection can be omitted. At the non-service time, the recording apparatus can be made thin and stored in a compact form under the personal computer (host) 40.

Figure 9:
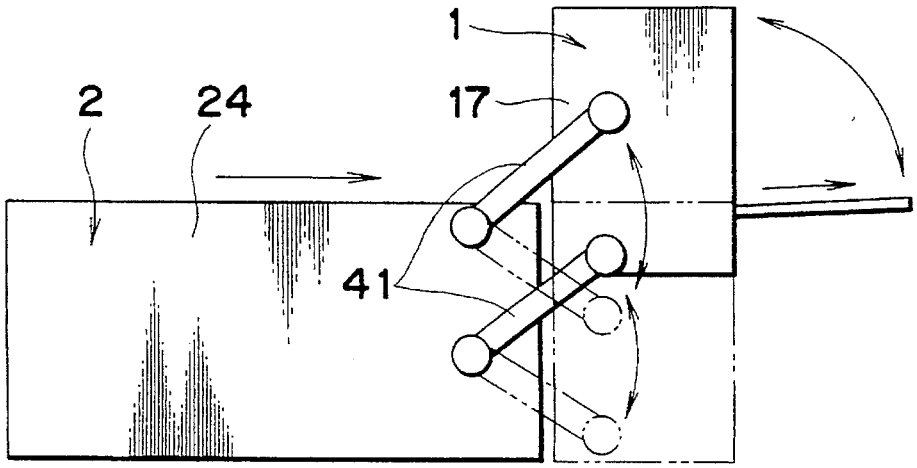
FIG. 9 is a schematic side view of a recording apparatus according to a fifth embodiment of the present invention.
Figure 10:
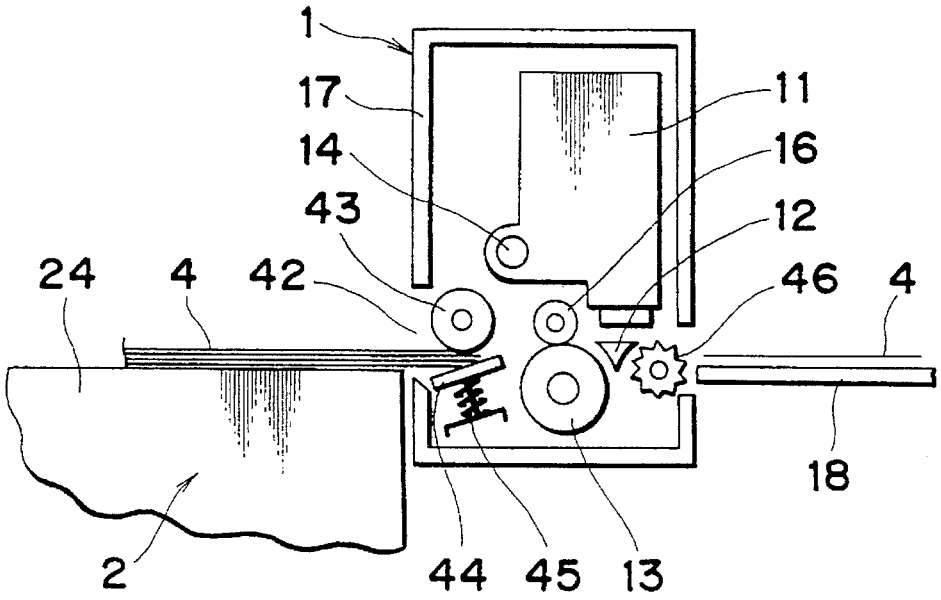
FIG. 10 is a schematic longitudinal cross-sectional view showing the internal structure of a recording mechanism unit for the recording apparatus of FIG. 9.

FIG. 9 is a schematic side view showing a recording apparatus according to the fifth embodiment of the present invention. FIG. 10 is a schematic longitudinal cross-sectional view showing the internal structure of the recording mechanism unit 1 in the recording apparatus of FIG. 9. In this fifth embodiment, the recording mechanism unit 1 is joined with the control unit 2 by means of two links (linkages) 41 provided on the left and right sides, as shown in FIG. 9, and is configured to change the form at the service and the non-service time by the use of substantially parallel movement but not rotation. That is, the recording mechanism unit 1 is movable between a non-service position (lowered position) as indicated by the two-dot chain lines and a service position (raised position) as indicated by the solid lines. The recording medium 4 is conveyed in a direction as indicated by the arrow in FIG. 9.

FIG. 10 shows the service state. In FIG. 10, near an recording medium insertion opening 42, there are disposed a pickup roller 43, a separation plate 44 and a separation spring 45. The frictional coefficient of a surface of the separation plate 44 is set to be higher than that of the recording medium 4, and lower than that of the pickup roller 43, whereby the separation plate is pressed against the pickup roller 43 by the separation spring 45. A plurality of sheets of recording medium inserted between the pickup roller 43 and the separation plate 44 are separated each one over a slanted plane of the separation plate 44, and each sheet is then fed to the paper feed roller 13. Subsequently, after being recorded by the recording head 11 at a position of the platen 12, the recording medium is exhausted on to a paper exhaust tray 18 by a paper exhaust roller 46. The fifth embodiment as shown in FIGS. 9 and 10 can be realized to the same effect as in the first embodiment as previously described, and in addition, the upper face of the control unit 2 can be also used as the paper supply tray to make more effective use of the space.

Figure 11:
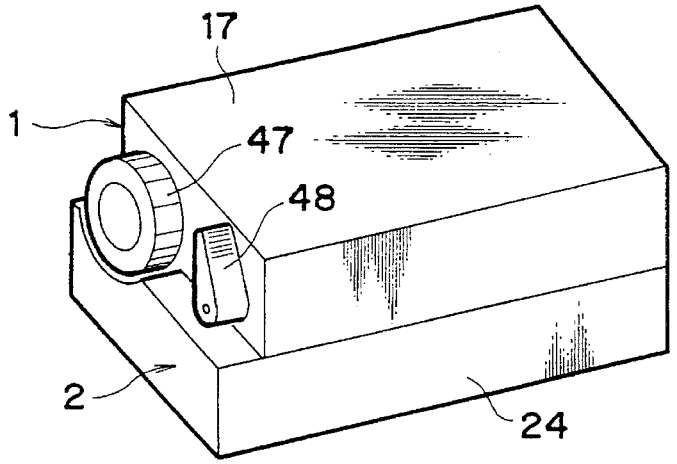
FIG. 11 is a schematic perspective view showing a state of a recording apparatus according to a sixth embodiment of the present invention at the non-service time.
Figure 12:
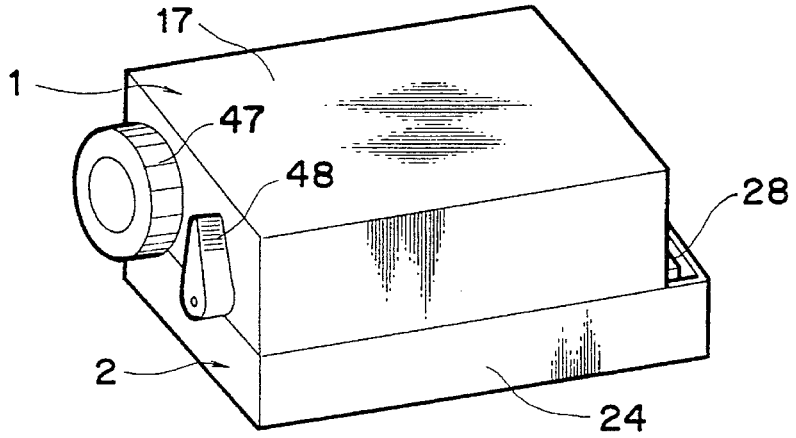
FIG. 12 is a schematic perspective view showing a state of the recording apparatus of FIG. 9 at the service time.
Figure 13:
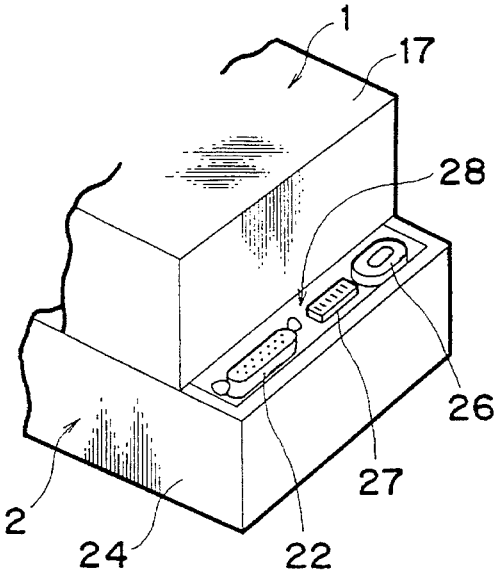
FIG. 13 is a schematic partial perspective view showing a connector portion for the recording apparatus as shown in FIG. 12.

FIG. 11 is a schematic perspective view showing a non-service state of a recording apparatus according to the sixth embodiment of the present invention, FIG. 12 is a schematic perspective view showing a service state of the recording apparatus of FIG. 11, and FIG. 13 is a schematic partial perspective view showing a connector portion 28 such as an interface connector arranged on the upper face of the control unit 2 in the recording apparatus of FIG. 11. The sixth embodiment is configured to change the form at the service time and the non-service time by shifting the recording mechanism unit 1 on the upper side and the control unit 2 on the lower side to the left or right. On the left side face of the recording mechanism unit 1, there is provided an operation unit comprising a knob 47 for the paper feed operation and a lever 48 for the switching operation, while at a right end portion on the upper surface of the control unit 2, there is arranged a connector portion 28 consisting of an interface connector 22, a power supply connector 26 and a dip switch 27 for the setting of functions.

The sixth embodiment as shown in FIGS. 11 to 13 is configured such that the projecting position (height from the left side) of the knob 47 and the lever 48 is substantially flush with or lower than (retracted from) the left side face of the control unit 2 at the non-service time so as not to make an obstruction. Further, at the non-service time, the connector portion 28 consisting of the interface connector 22, the power supply connector 26 and the dip switch 27 for the setting of functions which are arranged at the right end portion on the upper face of the control unit 2 can be covered with the recording mechanism unit 1. On the other hand, at the service time, the height position of the knob 47 and the lever 48 extending laterally projects (or protrudes) outwards from the side face of the recording apparatus (the left side face of the recording mechanism unit 1 and the control unit 2) so as to permit the user to readily operate them, as shown in FIGS. 12 and 13, while the connector portion 28 of the interface connector 22 and so on are exposed as shown in FIG. 13 to be connectable.

According to the sixth embodiment as shown in FIGS. 11 to 13, there is provided a recording apparatus which can be placed in a suitable form for the conveyance of the recording medium 4 at the service time, or in a convenient form for the transportation and storage at the non-service time, in which an operation unit portion not operated at the transportation and storage or the connector portion 28 such as the interface connector 22 can be effectively protected from being stained or damaged, by configuring the apparatus in such a manner that the recording mechanism unit 1 and the control unit 2 are respectively stored in separate cases 17 and 24, which are joined together to be relatively movable in left and right directions, whereby at the service time, the operation unit consisting of the knob 47 and the lever 48 is projected therefrom, and the interface connector 22 and the power supply connector 26 are exposed, while at the non-service time, the operation unit consisting of the knob 47 and the lever 48 is retracted therefrom, and the interface connector 22 and the power supply connector 26 are covered with the recording mechanism unit 1.

According to the first to sixth embodiments as above described, there is provided a recording apparatus which can be readily changed to an optimal form at the service time and the non-service time, because the recording apparatus is divided into the recording mechanism unit 1 and the control unit 2, which are stored in respective cases 17 and 24 and connected by the hinge portion 3 or coupling to be rotatable or movable in parallel movement, and the connector portion 28 such as the interface connector 22 and the power supply connector 26 is arranged on a mating face between the recording mechanism unit 1 and the control unit 2. And it can provide the recording apparatus in which the connector portion 28 such as the interface connector 22 or the power supply connector 26 which is an operation unit not operated during the non-service time can be securely protected during the non-service time.

Next, a recording apparatus in the form in which the supply of electrical energy to the recording apparatus is made by using a power supply adaptor attachable thereto will be described below.

In the seventh to eleventh embodiments as hereinafter described, the recording medium is conveyed in a straight direction, but it is more preferable to provide a U-shaped conveyance passage as previously described in the second embodiment.

Figure 14A:
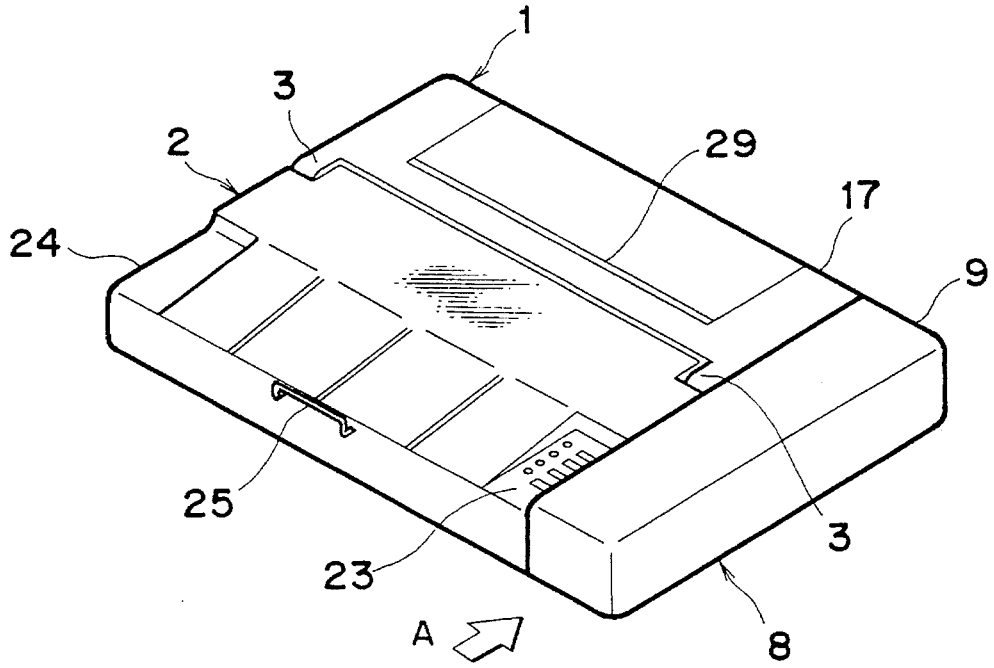
FIGS. 14A and 14B are perspective views showing the states of a recording apparatus according to a seventh embodiment of the present invention at the non-service state for the transportation and storage in FIG. 14A, and when a power source unit is separated therefrom in FIG. 14B.
Figure 14B:
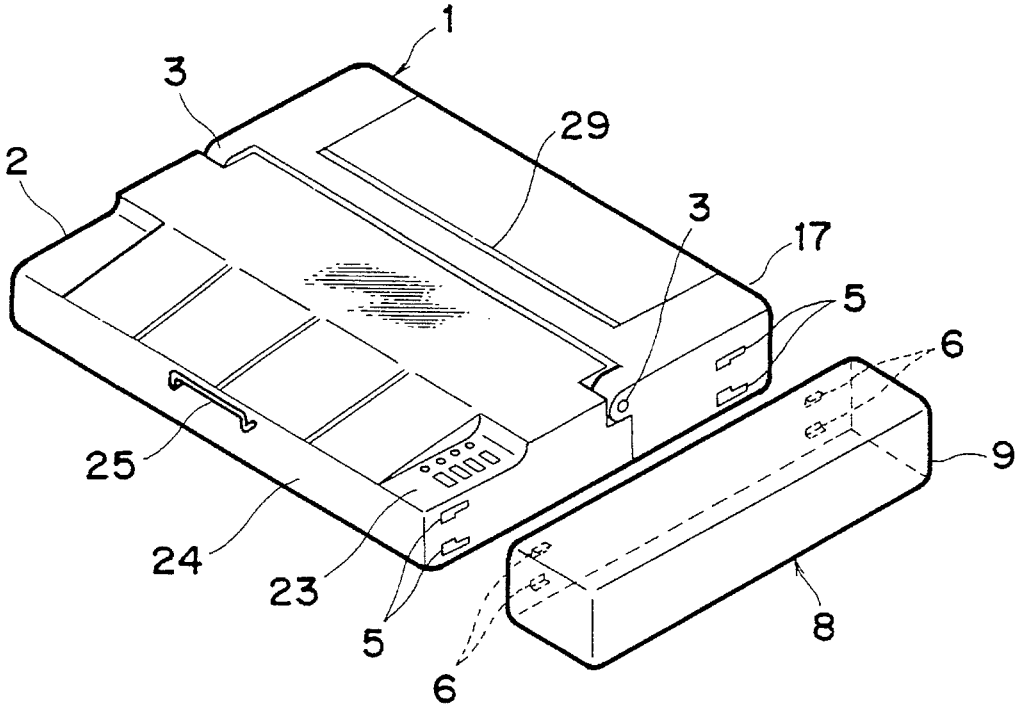
Figure 15A:
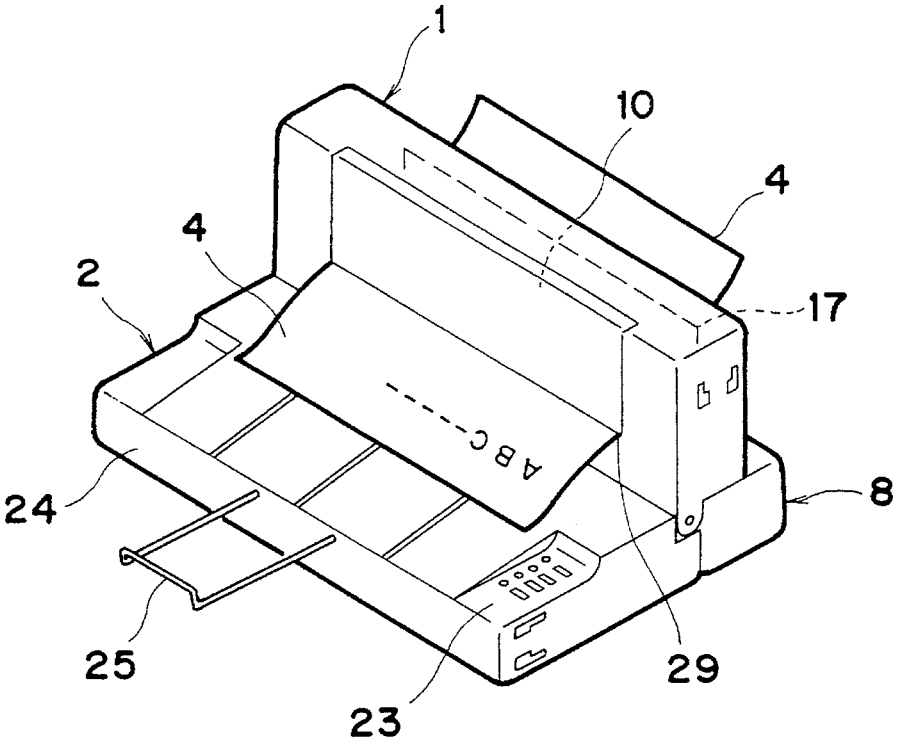
FIGS. 15A and 15B are perspective views showing the states of the recording apparatus according to the seventh embodiment of the present invention at the service time, as seen from the front face side in FIG. 15A and from the rear face side in FIG. 15B.
Figure 15B:
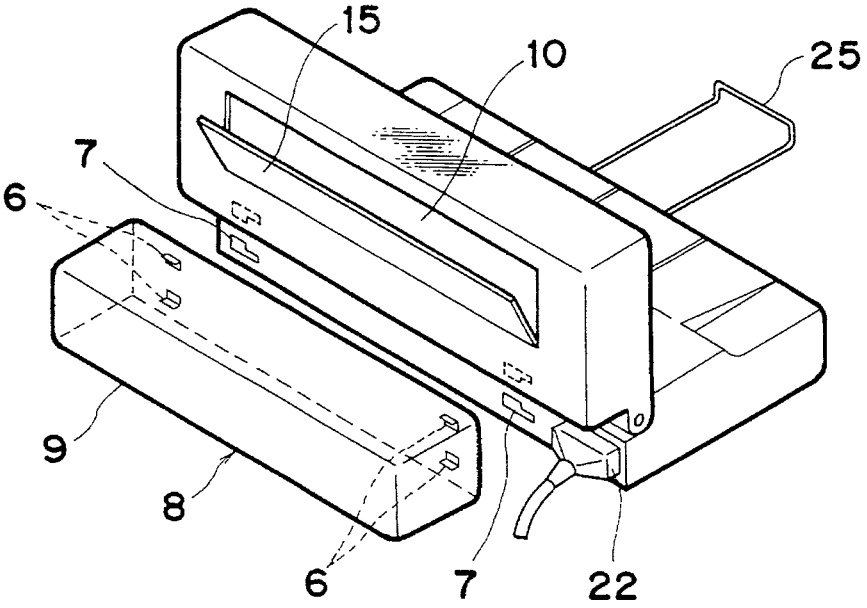

FIGS. 14 and 15 show the seventh embodiment of the present invention. In these figures, FIG. 14 shows a non-service state, in which FIG. 14A shows an integrated form and FIG. 14B shows a state in which a power source unit is separated from the state as shown in FIG. 14A. FIG. 15 shows a service state, in which FIG. 15A is a view as seen from the front side, and FIG. 15B is a view as seen from the rear face side, with the power source unit separated from the state of FIG. 15. In FIGS. 14A, 14B, 15A and 15B, 1 is a recording mechanism unit, 2 is a control unit, and 8 is a power source unit. Note that the recording mechanism unit 1 and the control unit 2 will be described in connection with FIG. 16.

Also, the recording mechanism unit 1, the control unit 2 and the power source unit 8 are electrically connectable in the service state. Note that a housing 17 of recording mechanism unit 1 is rotatably joined with a housing 24 of the control unit 2 via the hinge portion 3 provided on both sides thereof, in which both housings 17 and 24 are held flat in the non-service state as shown in FIG. 14. Further, the power source unit 8 is used as an adaptor for supplying a power to the whole apparatus, as well as driving the recording mechanism unit 1, and for example, Ni-Cd battery is stored in this embodiment, but it will be appreciated that the power source unit may be in the form of containing a power source such as dry battery or transformer inside. As shown in FIG. 14B, by engaging interlock portions 6, 6 provided on the side face of a housing 9 for the power source unit 8 into locking portions 5, 5 provided on the side face of the housing for the recording mechanism unit 1 and the control unit 2 in a direction of arrow A as indicated in FIG. 14A, the recording apparatus can be made in a convenient state for the transportation, and maintained in a compact and integral form with the relative displacement between the recording mechanism unit 1 and the control unit 2 constrained.

Referring now to FIGS. 15A and 15B, the recording apparatus in the service state will be described below. To put the apparatus to the service state, the power source unit 8 is once removed from the side face of each housing for the recording mechanism unit 1 and the control unit 2, as shown in FIG. 14B, and the recording mechanism unit 1 is raised by rotation via the hinge portion 3 so that the apparatus is placed in a state as shown in FIG. 15A. Thereafter, the power source unit 8 is inserted under the raised recording mechanism unit 1, as shown in FIG. 15B, and the interlock portions 6, 6 on the side of the power source unit 8 are engaged with locking portions 7, 7 exposed on the rear face side beneath the housing 17 of the control unit 2, as shown in FIG. 15A, whereby the apparatus can be placed in a suitable attitude for the service as a whole.

In FIGS. 14A, 14B, 15A and 15B, 25 is a tray for accepting exhausted sheets drawn out from the front face of the control unit 2, 23 is a panel switch provided at the side portion on the upper face of the control unit 2 so as not to obstruct the path of the exhausted sheet, 10 is a sheet insertion opening with a receiving plate 15 which is provided on the rear face side of the recording mechanism unit 1, and 22 is an I/F (interface) connector and its DIP switch provided at the lower portion on the rear face of the recording mechanism unit 1. The electrical connection between the control unit 2 and the power source unit 8 in the recording apparatus assembled in the service state is made via connector (not shown) to be connected simultaneously upon the connection of both portions, or a cord prepared separately, while the electrical connection between the control unit 2 and the recording mechanism unit 1 is performed by a freely bendable flexible cable not shown which is provided at a connecting portion of the hinge portion 3 for both portions.

In the recording apparatus reassembled into the service state, a sheet 4 is inserted through an insertion opening 10 on the rear face side, the recorded sheet 4 is exhausted from an exhausting portion 29 on the front side of the recording mechanism unit 1 on to the upper face of the control unit housing 24, as shown in FIG. 15A, and received into the exhausted sheet receiving tray 25.

A further provision of the U-shaped conveying passage as described in the second embodiment is more preferable because the excess space on the rear face is eliminated.

Figure 16:
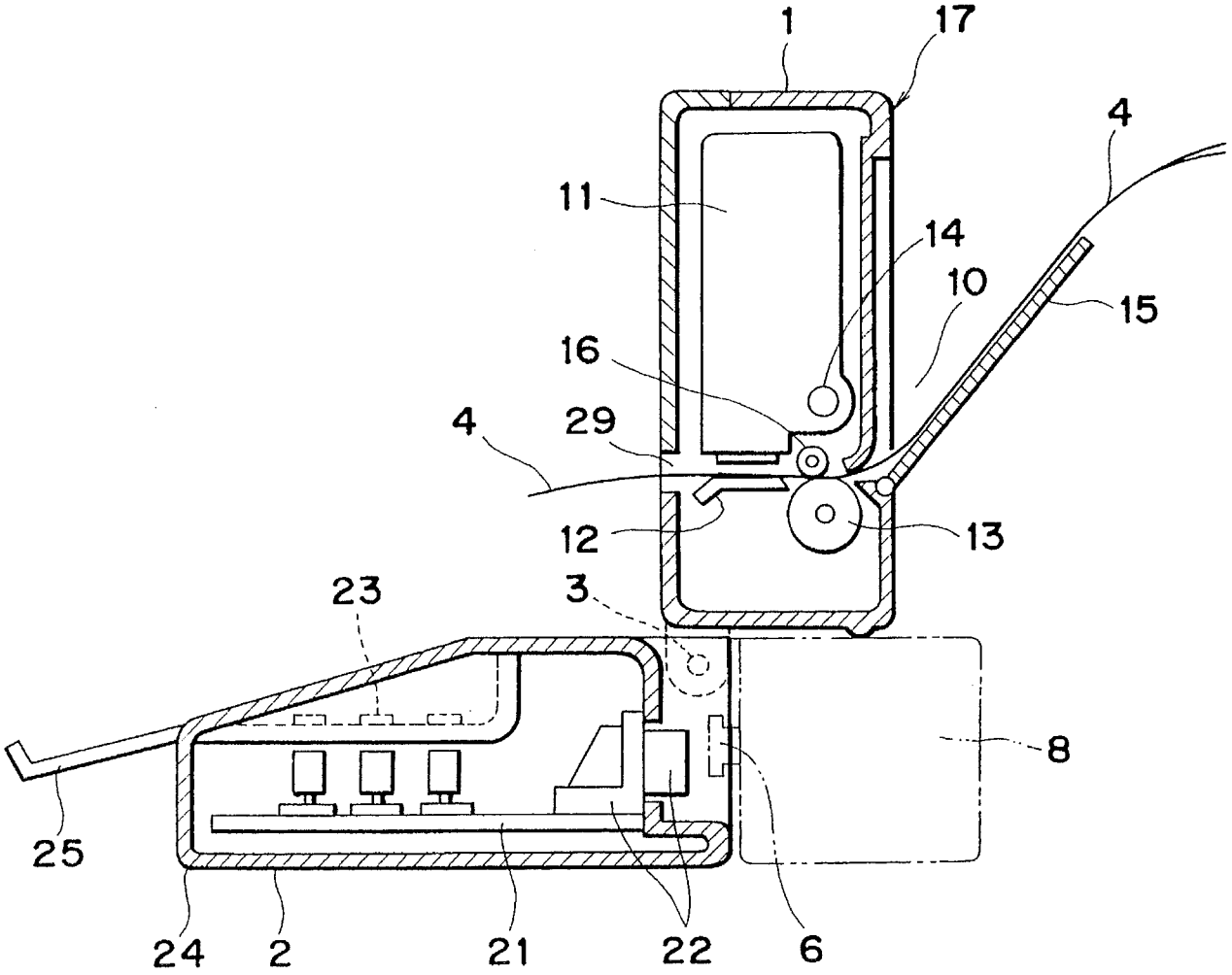
FIG. 16 is a cross-sectional view showing a constitution of the recording apparatus according to the seventh embodiment of the present invention in the service state.

FIG. 16 shows the constitution of a recording apparatus, in cross section, according to the seventh embodiment of the present invention, in which the power source unit 8 is indicated by the two-dot chain lines. In the recording mechanism unit 1, 13 is a feed roller, 16 is a pinch roller contacting and cooperative with the feed roller 13 in feeding the sheet, 12 is a plate-like platen for holding the recording sheet 4 fed to the recording position, 11 is a recording head (a unit of ink jet recording heads integral with an ink tank in this embodiment) for recording by scanning along the recording sheet 4 held on the platen 12, and 14 is a guide shaft for guiding the movement of the recording head 11 in a direction perpendicular to the paper face. Also, 21 is a control substrate provided within the housing 24 of the control unit 2, on which substrate there are disposed driving portions provided within the recording mechanism unit 1, and circuits (not shown) for supplying a signal to the recording head 11, whereby a variety of signals input via the panel switch 23 are supplied to the recording mechanism unit 1.

Figure 17:
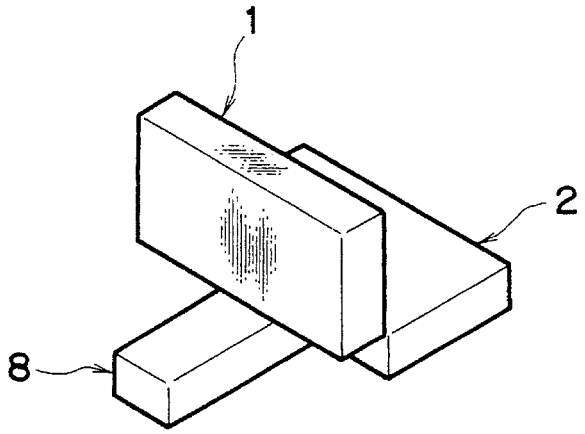
FIG. 17 is a perspective view showing the service state of a recording apparatus according to an eighth embodiment of the present invention.

FIG. 17 shows the outline of the eighth embodiment of the present invention. This eighth embodiment is configured such that the power source unit 8 is longitudinally inserted under the frame portion 17 of the recording mechanism unit 1 in a sheet feeding direction with the constitution as shown in FIG. 14. To achieve the engaged state between the power source unit 8 and the control unit 2, not shown in the figure, engagement means (comprised of 5, 5 and 6, 6) as shown in FIG. 14B may be provided on the joining face of both.

In this way, the recording apparatus capable of changing the attitude can be set more stably in forward and backward directions, and can secure a space irrelevant to the joining with the power source unit 8 on the rear face side of the control unit housing 24, so that it is possible to provide an operation unit such as an I/F connector, as well as a DIP switch or a reset switch. And at the non-service time, the operation unit is covered with the recording mechanism unit 1 to be surely protected.

Figure 18A:
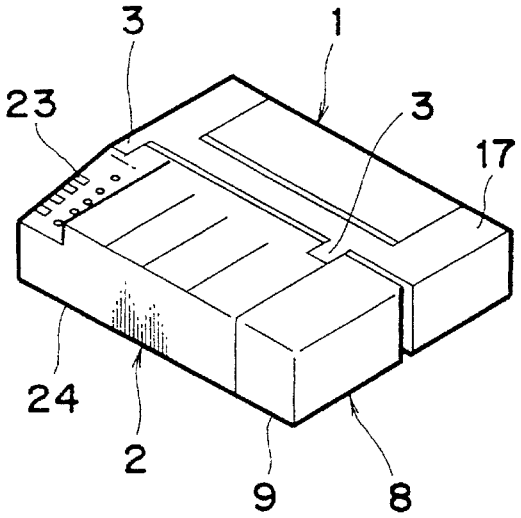
FIGS. 18A and 18B are perspective views showing the assembled forms of a recording apparatus according to a ninth embodiment of the present invention in the non-service stated and the service state, respectively.
Figure 18B:
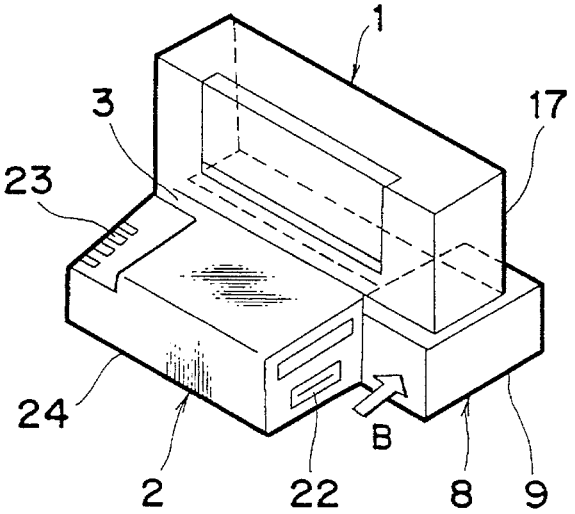

FIG. 18 shows the ninth embodiment of the present invention. In the ninth embodiment, the power source unit 8 is mountable on the side face of the control unit housing 24, and slidable along a guide portion for the slide provided on the side face of the control unit housing 24 in a direction of arrow B as shown in FIG. 18B. Also, in the ninth embodiment, the housing 24 of the control unit 2 and the housing 9 of the power source unit 8 are formed in the same shape of upper and lower cross sections including the sheet feeding direction in a stored state for transportation as shown in FIG. 18A, whereby only when the recording mechanism unit 1 is raised and placed in the service state as shown in FIG. 18B, the power source unit 8 can be slid in the direction of arrow B, so that the recording mechanism unit 1 can be held in a state supported by the power source unit 8. Note that in this case, the DIP switch can be held in a connectable and exposed state on the side face of the control unit housing 24, as shown in FIG. 18B.

While in the ninth embodiment as above described, the power source unit 8 is slidable with respect to the control unit 2, it is possible that after the recording apparatus 1 is changed from the flat state as shown in FIG. 18A to the standing state as shown in FIG. 18B, the power source unit 8 may be rotated in a horizontal direction around the longitudinal axis not shown, and received under the bottom face of the recording mechanism unit housing 17, or the power source unit may be in a detachable form as in the seventh embodiment.

Figure 19A:
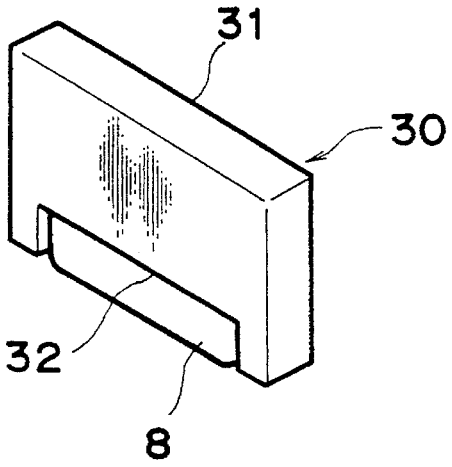
FIGS. 19A and 19B are schematic perspective views showing the assembled forms of a recording apparatus according to a tenth embodiment of the present invention in the non-service state and the service state, respectively.
Figure 19B:
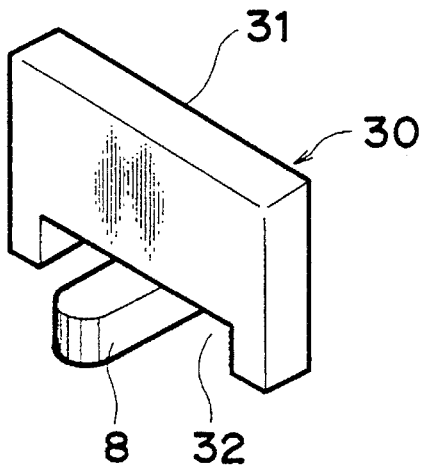

FIG. 19 shows the outline of the tenth embodiment of the present invention. The tenth embodiment is an example of a recording apparatus 30, in thin type and notebook size, in which the recording mechanism unit 1 and the control unit 2 are stored within an integral housing, in which at the service time, when the housing 31 is held in a standing service state, the power source unit 8 is provided on a portion excluding both end portions of the housing on the lower face side thereof, while at the non-service time, the power source unit 8 can be stored within a recess portion 32 under the recording apparatus housing 31. Thus, this recording apparatus is held in a longitudinal form at the service time, as shown in FIG. 19B, but can be placed in a more stable state by rotating the power source unit 8 about 90 degrees within the recess portion 32, with its bottom portion being "cruciform", to have a larger bottom area. Heretofore, there were some instances where a simple flat plate was made cruciform or T-shaped to enlarge the bottom face, but herein, owing to the use of the power source unit 8, it is possible to readily realize a portable recording apparatus of the notebook size without waste of the space though the apparatus is rigorous and larger by the thickness of the power source unit 8. Of course, the power source unit 8 may be in a detachable form, rather than in a rotational form as in the above embodiment for shifting or transforming the power source unit 8.

Figure 20A:
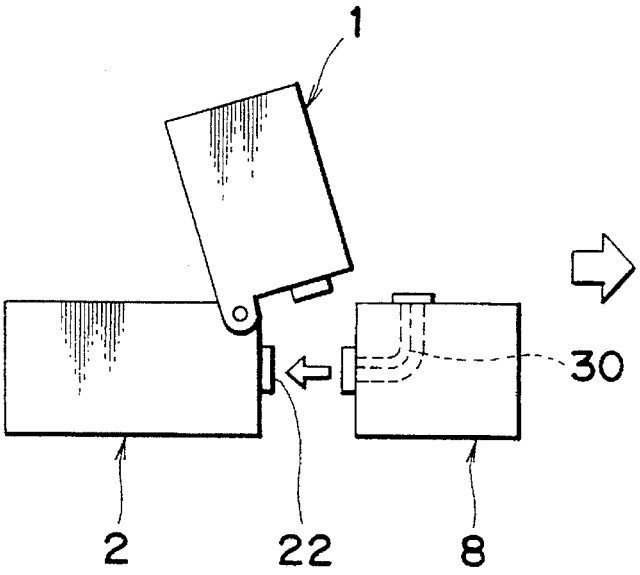
FIGS. 20A and 20B are explanation views showing the assembling form of a recording apparatus according to an eleventh embodiment of the present invention in sequence.
Figure 20B:
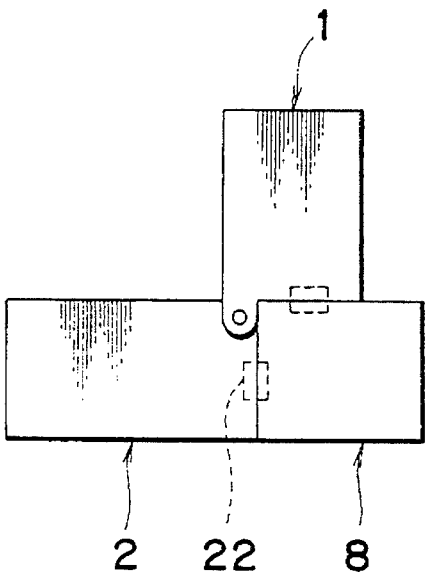

FIG. 20 shows the outline of the eleventh embodiment of the present invention. The eleventh embodiment is one in which the power source unit 8 contains a signal line 30 for supplying an electric signal from the control unit 2 to the recording mechanism unit 1, and when the apparatus is transformed into the service state, the control unit 2 and the recording mechanism unit 1 are electrically connected via the signal line 30 provided on the power source unit 8, as shown in FIGS. 20A and 20B. Thereby, there is no need for the flexible cable provided on a bendable portion between the control unit 2 and the recording mechanism unit 1.

While in the above-described embodiment, the present invention is applied to an ink jet recording apparatus, the present invention is also applicable to a variety of recording apparatuses such as a wire dot recording apparatus, a laser beam recording apparatus, a thermal transfer recording apparatus, or a thermal recording apparatus, without regard to recording method of recording means (recording head), to the same effect. While in the above-described embodiments a serial type recording apparatus making the scanning along the recording sheet with the recording means (recording head) 11 mounted on the carriage or as the recording means itself was exemplified, the present invention is also applicable to a line type recording apparatus using line type recording means corresponding to the whole or a part of the recording width for the recording sheet to the same effect.

Further, the present invention is also applicable to a variety of recording apparatuses such as monochrome recording apparatus using a single recording head, a color recording apparatus using a plurality of recording means for recording with different colors, or a recording apparatus for the gradation recording using a plurality of recording means for recording at different densities of the same color, whereby the same effects can be accomplished. Further, the present invention is also applicable in any form of recording means (recording head), such as a cartridge type having a recording head and an ink tank integrally formed, and a type having a recording head and an ink tank separately provided and connected via an ink supply tube, irrespective of the constitution between the recording means and the ink tank, whereby the same effect can be accomplished.

When the present invention is applied to an ink jet recording apparatus, it can be applied to those using recording means (recording head) with electricity-heat converters such as piezoelectric elements, among which an ink jet recording apparatus using recording means relying on the method of discharging the ink by the use of the heat energy can achieve the excellent effects. With such a method, the higher density and definition of recording can be accomplished.

It is preferable to employ the typical structure and the principle disclosed in, for example, U.S. Pat. No. 4,723,129 and U.S. Pat. No. 4,740,796. This system can be adopted in so-called "On-Demand" type and "Continuous" type structures. In particular, the "On-Demand" type is more preferable, because an electrothermal conversion member disposed to align to a sheet or a liquid passage in which liquid (ink) is held is supplied with at least one drive signal which corresponds to information to be recorded and which enables the temperature of the electrothermal conversion member to be raised higher than a nucleate boiling point, so that thermal energy is generated in the electrothermal conversion member and film boiling is caused to take place on the surface of the recording head which is heated. As a result, bubbles can be respectively formed in liquid (ink) in response to the drive signals.

Due to the enlargement and contraction of the bubble, liquid (ink) is discharged through the discharge port, so that at least one droplet is formed. In a case where the aforesaid drive signal is made to be a pulse signal, a further satisfactory effect can be obtained in that the bubble can immediately and properly be enlarged/contracted and liquid (ink) can be discharged while exhibiting excellent responsiveness. It is preferable to employ a drive signal of the pulse signal type disclosed in U.S. Pat. No. 4,463,359 and U.S. Pat. No. 4,345,262. Furthermore, in a case where conditions for determining the temperature rise ratio on the aforesaid heated surface disclosed in U.S. Pat. No. 4,313,124 are adopted, a further excellent recording operation can be performed.

In addition to the structure (a linear liquid passage or a perpendicular liquid passage) of the recording head formed by combining the discharge ports, the liquid passage and the electrothermal conversion member as disclosed in the aforesaid specifications, a structure disclosed in U .S. Pat. No. 4,558,333 and U.S. Pat. No. 4,459,600 in which the heated portion is disposed in a bent portion is included in the scope of the present invention. Furthermore, the present invention can effectively be embodied in a structure in which a common slit is made to be the discharge portion of a plurality of electrothermal conversion members and which is disclosed in Japanese Patent Appln. Laid-Open No. 59-123670 and a structure in which an opening for absorbing thermal energy pressure waves is formed to align to the discharge port and which is disclosed in Japanese Patent Appln. Laid-Open No. 59-138461. That is, the present invention can ensure an efficient recording in whatever form the recording head may be.

A full line type recording head having a length which corresponds to the width of the maximum recording medium which can be recorded by the recording apparatus may be a structure capable of realizing the aforesaid length and formed by combining a plurality of recording heads as disclosed in the aforesaid specifications or a structure formed by an integrally formed recording head. The present invention will enable the aforesaid effects to be exhibited further effectively. In addition, the present invention can also be effectively adapted to a structure having an interchangeable chip type recording head which can be electrically connected to the body of the apparatus or to which ink can be supplied from the body of the apparatus when it is mounted on the body of the apparatus or a cartridge type recording head integrally formed to the recording head.

Also, addition of a restoration means for the recording means, a preliminary auxiliary means, etc. provided as the constitution of the recording device is preferable because the effects of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform preliminary mode which performs discharging separate from recording.

Further, as the type of the recording head to be mounted and the number of heads, the present invention is effective to either a single recording head provided corresponding to a monochrome ink or a plurality of recording heads provided corresponding to a plurality of inks having different recording colors or densities. That is, as the recording mode of the ink jet recording device, the present invention is extremely effective for not only the recording head only of a primary color such as black, etc., but also a device equipped with at least one of plural different colors or full color by color mixing, whether the recording head may be either integrally constituted or combined in plural number.

Though the ink is considered as being liquid in the embodiments of the present invention as above described, the present invention is applicable to either ink that is solid below room temperature, and softened or liquefied at or above room temperature, and ink that is liquefied when a recording enable signal is issued as it is common with the ink jet recording device to control the viscosity of ink to be maintained within a certain range of the stable discharge by adjusting the temperature of ink in a range from 30° to 70° C. In addition, in order to avoid the temperature elevation due to the heat energy by positively utilizing the heat energy for the change of state from solid to liquid, or to prevent the ink from evaporating by the use of the ink remaining solid in the shelf state, the ink having a property of liquefying only with the application of heat energy, such as the ink liquefying with the application of heat energy in accordance with a recording signal so that liquid ink is discharged, or the ink already solidifying upon reaching a recording medium, is also applicable in the present invention.

In this case, the ink may be in the form of being held in recesses or through holes of porous sheet as liquid or solid matter, and opposed to electricity-heat converters, as described in Japanese Patent Application Laid-Open No. 54-56847 or Japanese Patent Application Laid-Open No. 60-71260. The most effective method for inks as above described in the present invention is based on the film boiling.

In addition, the ink jet recording apparatus according to the present invention may be used in the form of an image output terminal of the information processing equipment such as a computer, a copying machine in combination with a reader, or a facsimile apparatus having the transmission and reception feature.

As above detailed, it is possible to provide a highly reliable recording apparatus excellent in handling, by taking an appropriate form of the apparatus depending on whether the recording apparatus is used or not.

What is claimed is:

1. A recording apparatus for recording on a recording medium, said apparatus comprising:

a control section housing having a control section for controlling said recording apparatus;

a recording section housing having a recording section for recording on a recording medium, a recording area where said recording section records on the recording medium and a conveying mechanism for conveying the recording medium to the recording area and exhausting the recording medium from the recording area, said recording section housing having a height substantially equal to a height of said control section housing; and a connecting mechanism for movably connecting said control section housing and said recording section housing between a standby position where said recording section housing is supported at a substantially equal level as that of the control section housing with respect to said control section housing and a recordable position where said recording section housing is moved to a relatively higher level than the level at the standby position with respect to said control section housing, wherein at the recordable position said control section housing and said recording section housing define a substantially linear recording medium conveying route from an upper portion of an outer surface of said control section housing to the recording area of said recording section housing.

2. The recording apparatus according to claim 1, wherein said recording section comprises an ink jet recording head for recording onto the recording medium by discharging ink.

3. The recording apparatus according to claim 1, wherein said recording section comprises an ink jet recording head for recording by energizing electricity-heat converters in response to a recording signal and discharging ink by film boiling caused in the ink due to heat energy produced by said electricity-heat converters.

4. The recording apparatus according to claim 3, wherein said ink jet recording head contains the ink for use in recording.

5. A recording apparatus according to claim 1, wherein said outer surface of said control section housing serves as a mounting portion for mounting the recording medium to be guided to the recording area when said recording section housing is moved to the recordable position.

6. A recording apparatus according to claim 1, wherein a part of a side of said recording section housing rotates and serves as a sheet exhausting tray.

7. A recording apparatus for recording on a recording medium, said apparatus comprising:

a control section housing having a control section for controlling said recording apparatus;

a recording section housing having a recording section for recording on a recording medium, a recording area where said recording section records on the recording medium and a conveying mechanism for conveying the recording medium to the recording area and exhausting the recording medium from the recording area; and a connecting mechanism for movably connecting said control section housing and said recording section housing between a standby position where said recording section housing is supported opposed to a rear side of said control section housing with respect to said control section housing and a recordable position where said recording section housing is moved to a relatively higher position than the standby position with respect to said control section housing, wherein at said recordable position said control section housing and said recording section housing define a substantially linear recording medium conveying route from an upper portion of an outer surface of said control section housing to the recording area of said recording section housing.

8. The recording apparatus according to claim 7, wherein said ink jet recording head performs recording by energizing electricity-heat converters in response to a recording signal and discharging ink by the use of film boiling caused in the ink due to heat energy produced by said electricity-heat converters.

9. The recording apparatus according to claim 8, wherein said ink jet recording head contains the ink for use in recording.

10. A recording apparatus according to claim 7, wherein said outer surface of said control section housing serves as a mounting portion for mounting the recording medium to be guided to the recording area when said recording section housing is moved to the recordable position.

11. A recording apparatus according to claim 7, wherein a part of a side of said recording section housing rotates and serves as a sheet exhausting tray.

12. The recording apparatus according to claim 7, wherein said recording section comprises an ink jet recording head for recording onto the recording medium by discharging ink.

13. An ink jet recording apparatus for recording on a recording medium by discharging ink, said apparatus comprising:

a first housing for housing an ink jet recording area at which ink is discharged onto the recording medium to record, and a conveying mechanism for conveying the recording medium to the ink jet recording area and exhausting the recording medium from the ink jet recording area; and a second housing hingedly connected to a rear side of said first housing, said second housing being rotatable with respect to said first housing between a retracted position where said first housing and second housing are aligned to define a straight contour and a recordable position where said first housing and second housing define an L-shape contour, wherein at said recordable position said first and second housings define a substantially linear recording medium conveying route from an upper portion of an outer surface of said first housing to the ink jet recording area of said second housing.

14. The recording apparatus according to claim 13, further comprising an ink jet recording section for recording on the recording medium at the recording area.

15. The recording apparatus according to claim 14, wherein said recording section comprises an ink jet recording head for recording by energizing electricity-heat converters in response to a recording signal and discharging ink by film boiling caused in the ink due to heat energy produced by said electricity-heat converters.

16. The recording apparatus according to claim 15, wherein said ink jet recording head contains the ink for use in recording.

17. The recording apparatus according to claim 13, wherein said outer surface of said first housing serves as a mounting portion for mounting the recording medium to be guided to the recording area when said second housing is moved to the recordable position.

18. The recording apparatus according to claim 13, wherein said first housing is substantially as high as said second housing before said second housing is rotated to the recordable position.

19. A recording apparatus according to claim 13, wherein a part of a side of said second housing rotates and serves as a sheet exhausting tray.

* * * * *

UNITED STATES PATENT AND TRADEMARK OFFICE

CERTIFICATE OF CORRECTION

PATENT NO. : 5,475,413 Page 1 of 2

DATED : December 12, 1995

INVENTOR(S) : Kenichiro HASHIMOTO, ET AL.

It is certified that error appears in the above-indentified patent and that said Letters Patent is hereby corrected as shown below:

COLUMN 1:

Line 60, "that's" should read --that is--.

COLUMN 3:

Line 12, "stated" should read --state--.

COLUMN 4:

Line 60, "unit 1. 10 The" should read --unit 1. ¶ The--.

COLUMN 5:

Line 45, "space" should read --space needed--.

UNITED STATES PATENT AND TRADEMARK OFFICE

CERTIFICATE OF CORRECTION

PATENT NO. : 5,475,413 Page 2 of 2

DATED : December 12, 1995

INVENTOR(S) : Kenichiro HASHIMOTO, ET AL.

It is certified that error appears in the above-indentified patent and that said Letters Patent is hereby corrected as shown below:

COLUMN 15:

Line 25, "and" should read --and said--;
Line 27, "and" should read --and said--.

Signed and Sealed this

Twelfth Day of March, 1996

Bruce Lehman

*Attest:*

BRUCE LEHMAN

*Attesting Officer*

*Commissioner of Patents and Trademarks*